US008419097B2

(12) United States Patent
Lunde

(10) Patent No.: US 8,419,097 B2
(45) Date of Patent: Apr. 16, 2013

(54) GRIPPER FOR PETROLEUM PIPES

(75) Inventor: Ola Lunde, Hafrsfjord (NO)

(73) Assignee: Seabed Rig AS (NO)

( * ) Notice: Subject to any disclaimer, the term of this patent is extended or adjusted under 35 U.S.C. 154(b) by 0 days.

(21) Appl. No.: 13/391,042

(22) PCT Filed: Aug. 18, 2010

(86) PCT No.: PCT/NO2010/000309

§ 371 (c)(1),
(2), (4) Date: Feb. 28, 2012

(87) PCT Pub. No.: WO2011/021943

PCT Pub. Date: Feb. 24, 2011

(65) Prior Publication Data

US 2012/0146353 A1 Jun. 14, 2012

(30) Foreign Application Priority Data

Aug. 19, 2009 (NO) ..... 20092864

(51) Int. Cl.
*B25J 15/00* (2006.01)

(52) U.S. Cl.
USPC ..... 294/198; 294/202; 294/115

(58) Field of Classification Search ..... 294/194, 294/198, 202, 90, 104, 106, 115; 269/32, 269/34
See application file for complete search history.

(56) References Cited

U.S. PATENT DOCUMENTS

| | | | | |
|---|---|---|---|---|
| 2,951,725 A | | 9/1960 | St. Jean | |
| 3,123,230 A | * | 3/1964 | Oppenheimer et al. | 414/1 |
| 3,451,711 A | | 6/1969 | Carpenter | |
| 3,938,846 A | * | 2/1976 | Yuryan | 294/106 |
| 4,368,913 A | * | 1/1983 | Brockmann et al. | 294/106 |
| 4,403,897 A | | 9/1983 | Willis | |
| 4,595,333 A | * | 6/1986 | Ono et al. | 414/729 |
| 4,600,357 A | * | 7/1986 | Coules | 414/730 |
| 4,810,019 A | * | 3/1989 | Brucher | 294/106 |

(Continued)

FOREIGN PATENT DOCUMENTS

| | | |
|---|---|---|
| GB | 2089708 A | 6/1982 |
| JP | 5061291 A | 8/1993 |
| WO | 02074495 A1 | 9/2002 |

OTHER PUBLICATIONS

Written Opinion of the International Searching Authority issued in connection with PCT/NO2010/000309.

(Continued)

*Primary Examiner* — Dean Kramer

(74) *Attorney, Agent, or Firm* — Akerman Senterfitt

(57) ABSTRACT

A gripper for petroleum pipes, the gripper including a housing and two gripper arms. The gripper arms are provided, at end portions, with gripping surfaces and are pivotable, at opposite end portions, around respective first axes. Each of the gripper arms is connected to the housing by respective first pivotal links, each of the first pivotal links being pivotably connected to the respective gripper arm around a second axis which is between the gripping surface and the first axis. Each of the first pivotal links is pivotably connected to the housing around a third axis, and each of the gripper arms is connected to the housing by a respective second pivotal link around the first axis. Each of the second pivotal links is pivotably connected to the housing on respective fourth axis fixed relative to the housing, the two first pivotal links being independently pivotable.

10 Claims, 3 Drawing Sheets

I–I

U.S. PATENT DOCUMENTS

| | | | | |
|---|---|---|---|---|
| 4,863,204 | A * | 9/1989 | Peters | 294/115 |
| 5,284,375 | A | 2/1994 | Land, III | |
| 5,418,607 | A | 5/1995 | Tani | |
| 6,056,341 | A * | 5/2000 | Bliss | 294/198 |
| 8,132,835 | B2 * | 3/2012 | Ban et al. | 294/2 |

OTHER PUBLICATIONS

International Search Report issued in connection with PCT/NO2010/000309.

* cited by examiner

I–I

GRIPPER FOR PETROLEUM PIPES

This application is a national phase of PCT/NO2010/000309, filed Aug. 18, 2010, and claims priority to NO 20092864 filed Aug. 19, 2009, the entire contents of both of which are hereby incorporated by reference.

This invention relates to a gripper for petroleum pipes. More particularly, it relates to a gripper for petroleum pipes, the gripper including a housing and a gripper arm, the gripper arm being provided, at its one end portion, with a gripping surface and being pivotable, at its opposite end portion, around a first axis, and the gripper arm being connected to the housing by means of a first pivotal link, the first pivotal link being pivotably connected to the gripper arm around a second axis which is between the gripping surface and the first axis, and the first pivotal link being pivotably connected to the housing around a third axis.

During automated handling of petroleum pipes, for example by means of a pipe manipulator, it is advantageous to use a gripper which is designed to grip around pipes of different diameters, while, at the same time, the centre position of the pipe relative to the gripper is known.

By petroleum pipes, hereinafter called pipes, are meant in this connection pipes that are used during the construction and operation of boreholes in the ground.

U.S. Pat. No. 5,284,375 discloses a gripper, in which two gripper arms, which are provided with gripping surfaces at their one end portions, are pivotably connected, at their opposite end portions, to a shaft which is radially movable relative to a housing. Each gripper arm is connected to the housing by means of a pivotal link which is pivotably connected to the gripper arms in a position between the gripping surface and the shaft, and to the housing by means of an axle.

The gripper according to U.S. Pat. No. 5,284,375 is not designed to handle pipes considerably different in diameter.

The invention has for its object to remedy or reduce at least one of the drawbacks of the prior art.

The object is achieved in accordance with the invention through the features which are specified in the description below and in the claims that follow.

A gripper for petroleum pipes is provided, the gripper including a housing and a gripper arm, and the gripper arm being provided, at its one end portion, with a gripping surface and being pivotable, at its opposite end portion, around a first axis, and the gripper arm being connected to the housing by means of a first pivotal link, the first pivotal link being pivotably connected to the gripper arm around a second axis which is between the gripping surface and the first axis, and the first pivotal link being pivotably connected to the housing around a third axis. The gripper is characterized by a second pivotal link being pivotably connected to the gripper arm around the first axis and being connected, pivotable around a fourth axis, to the housing.

The gripper may thereby be designed to work within a relatively wide range of diameters.

The gripper may include two gripper arms which are arranged on opposite sides of the housing. If the gripper arms and pivotal links are symmetrical, a pipe which is being gripped will be positioned centrically relative to the gripper regardless of the diameter within the work range of the gripper.

The housing may include an abutment surface for the petroleum pipe. As the gripper arms grip around the pipe, the pipe is moved towards the abutment surface and the pipe is thereby moved against the abutment surface when the gripper is in its active position.

Since the pipe diameter is known, the centre position of the pipe relative to the gripper is also known, as the pipe is centric relative to the gripper and the distance from the abutment to the pipe centre is known.

To achieve the desired operation with the possibility of gripping around pipes of different diameters, the distance between the first axis and the fourth axis may be different from the distance between the second axis and the third axis. The distance between the first axis and the second axis may also be different from the distance between the third axis and the fourth axis. It is obvious that the distances between the different axes must be adapted to the pipe dimensions that are to be gripped.

A fourth axle which is concentric with the fourth axis may be provided with a toothed wheel engaging a movable pitch rack, the fourth axle being arranged to transmit torques between the toothed wheel and the second pivotal link.

The pitch rack may be connected to a piston rod belonging to a linear actuator. The pitch rod cooperates with the toothed wheel to pivot the second pivotal link and thereby move the gripper between a passive, open position and an active, closed position.

The linear actuator may be in the housing between the third axis and the fourth axis. Thereby, a relatively compact construction is achieved while, at the same time, the linear actuator is protected from damage from the outside. The linear actuator may also be placed entirely or partially outside the housing.

The device according to the invention provides a gripper which is arranged to work with pipes within a relatively wide range of diameters, while at the same time, the centre position, relative to the gripper, of a pipe which is in the gripper is known.

In what follows is described an example of a preferred embodiment which is visualized in the accompanying drawings, in which.

Figure 1:
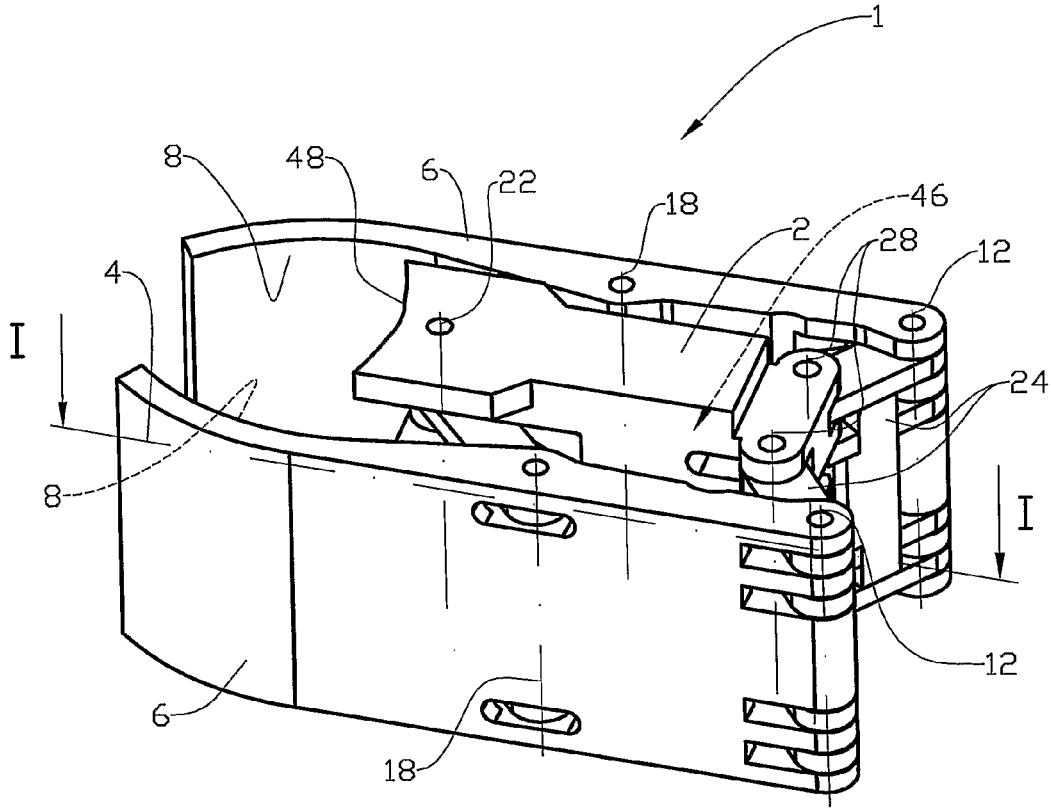
FIG. 1 shows, in perspective, a gripper in accordance with the invention.

In the drawings, the reference numeral 1 indicates a gripper for a pipe, the gripper 1 being connected to a pipe manipulator not shown, and the gripper including a housing 2 with a plane of symmetry 4 and two gripper arms 6 arranged on opposite sides of the housing 2.

The gripper arm 6 is formed, on the inside of its one end portion, with a concave gripping surface 8 and is pivotable, at its opposite end portion, around a first axle 10 which has a first axis 12.

By means of a second axle 16 with a second axis 18, a first pivotal link 14 is pivotably connected to the gripper arm 6 in a position between the gripping surface 8 and the first axis 12. At its opposite end portion, the first pivotal link 14 is pivotably connected to the housing 2 by means of a third axle 20 which has a third axis 22.

A second pivotal link 24 is pivotably connected to the first axle 10 and is connected at its opposite end portion to the housing 2 by means of a fourth axle 26 which has a fourth axis 28.

The axes 12, 18, 22, 28 are parallel to the centre axis 32 of a gripped pipe 30, and constitute, at the same time, longitudinal axes in their respective axles 10, 16, 20, 26. The pivotal links 14, 24 are connected to their respective axles 10, 16, 20, 26 by means of fork-like connections.

Each of the fourth axles 26 is provided with a respective toothed wheel 34. In this preferred exemplary embodiment the toothed wheels are constituted by a toothed-wheel sector. The toothed wheels 34 and the second pivotal links 24 are rotationally rigidly connected to their respective fourth axles 26.

Both the toothed wheels 34 are in mesh with a pitch rack 36 which is movable along the plane of symmetry 4. The pitch rack 36 is formed with surrounding teeth.

The pitch rack 36 is connected to a piston rod 38 which extends sealingly, via an end wall 40, in to a piston 42. The piston 42 is sealingly movable in a bore 44 in the housing 2.

The piston rod 38, end wall 40, piston 42 and bore 44 constitute a linear actuator 46, which is supplied with driving fluid, in a manner known per se, via channels not shown.

The end portions of the gripper arms 6 which are provided with gripping surfaces 8 project from the housing 2 and are, owing to their own symmetry and that of the pivotal links 14, 24, equidistant from the housing 2 and the plane of symmetry 4 of the housing 2 in all positions.

Figure 3:
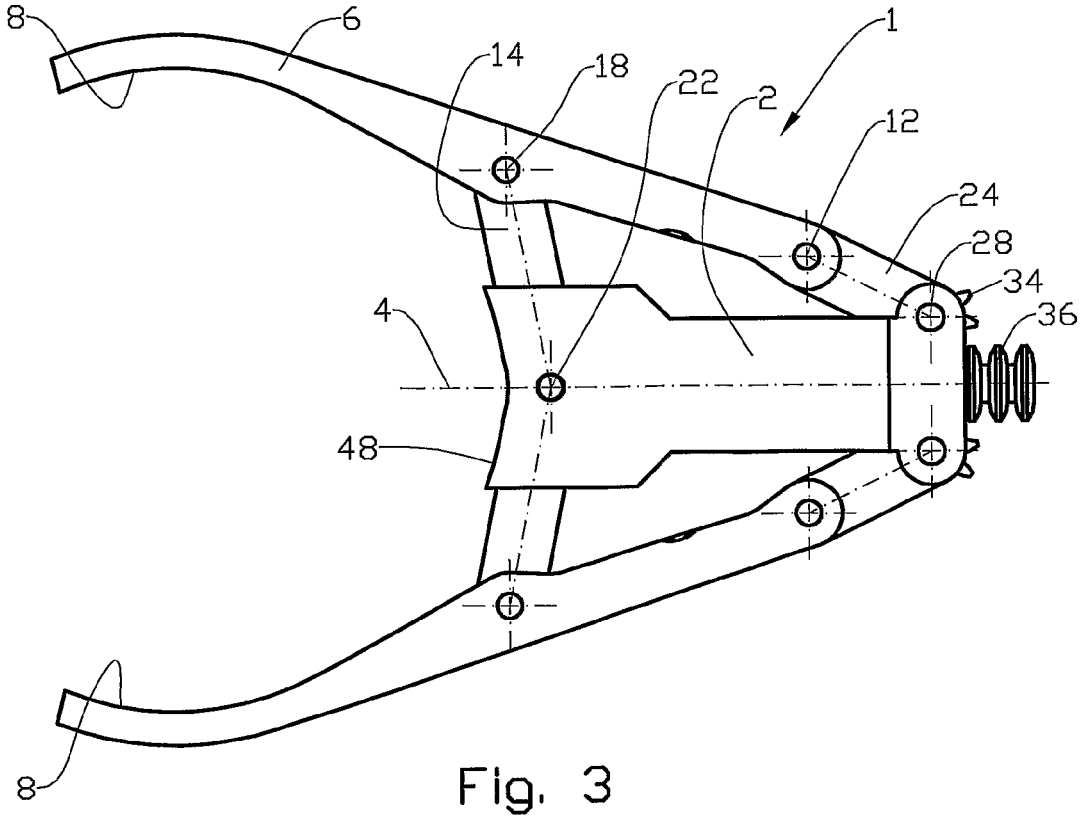
FIG. 3 shows a plan view of the gripper in a fully open position.

When the pitch rack 36 is in its fully extended position, see FIG. 3, the second pivotal links 24 have been pivoted in such a way that, owing to the chosen relative positions of the axes 12, 18, 22 and 28, the gripper arms have been moved into their open, passive positions.

Figure 2:
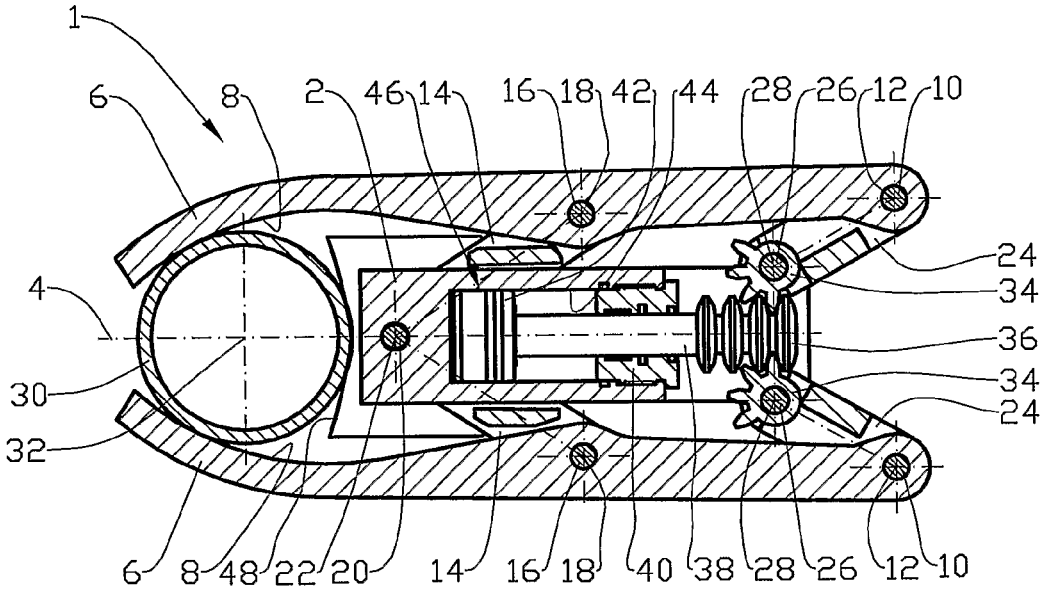
FIG. 2 shows a section I-I of FIG. 1, but in which the gripper grips around a pipe of a relatively small diameter.
Figure 4:
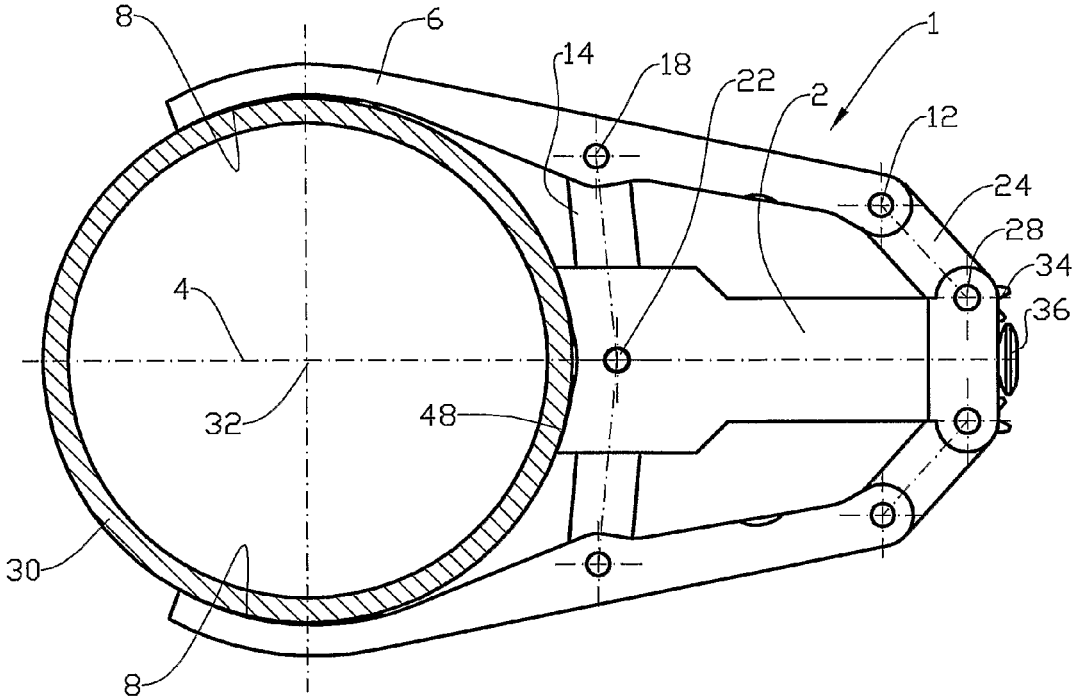
FIG. 4 shows a plan view of the gripper, the gripper gripping around a pipe of a relatively large diameter.
Figure 5:
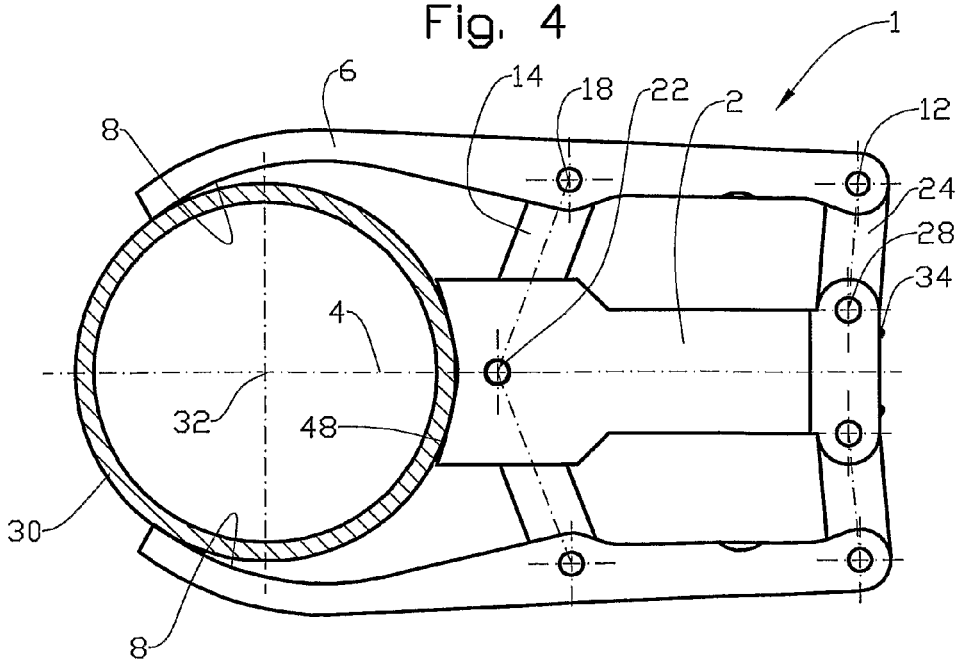
FIG. 5 shows the same as FIG. 4, but the gripper is gripping around a pipe of a somewhat smaller diameter.

When the pitch rack 36 is retracted in the direction towards the housing 2, the gripper arms 6 are simultaneously moved inwards towards the plane of symmetry 4 and towards the housing 2. A pipe 30 which is between the gripper arms 6 is thereby pulled in against an abutment surface 48 on the housing 2 while being clamped at the same time, see FIGS. 2, 4 and 5.

The centre axis 32 of the pipe is thereby in the plane of symmetry 4 at a known distance from the abutment surface 48 and thereby the housing 2.

The invention claimed is:

1. A gripper for petroleum pipes, the gripper including:

a housing;

two gripper arms, wherein the gripper arms are provided, at first end portions, with gripping surfaces and are pivotable, at opposite end portions, around respective first axes;

first pivotal links connecting each of the gripper arms to the housing, each of the first pivotal links being pivotably connected to the respective gripper arm around a second axis which is between the gripping surface and the first axis, and each of the first pivotal links being pivotably connected to the housing around a third axis; and second pivotal links around the first axis connecting each of the gripper arms to the housing, wherein each of the second pivotal links is pivotably connected to the housing on a respective fourth axis fixed relative to the housing, the two first pivotal links being independently pivotable from the two second pivotal links;

wherein the distance between the first axis and the fourth axis is shorter than the distance between the second axis and the third axis; and wherein the housing includes an abutment surface for the petroleum pipe.

2. The gripper in accordance with claim 1, wherein the gripper includes two gripper arms which are arranged on opposite sides of the housing.

3. The gripper in accordance with claim 1, wherein the petroleum pipe is moved against the abutment surface when the gripper is in its active position.

4. The gripper in accordance with claim 1, wherein the distance between the first axis and the second axis is different from the distance between the third axis and the fourth axis.

5. The gripper in accordance with claim 1, wherein a fourth axle which is concentric with the fourth axis is provided with a toothed wheel which is in mesh with a movable pitch rack, the fourth axle being arranged to transmit torques between the toothed wheel and the second pivotal link.

6. The gripper in accordance with claim 5, wherein the pitch rack is connected to a piston rod belonging to a linear actuator.

7. The gripper in accordance with claim 6, wherein the linear actuator is between the third axis and the fourth axis in the housing.

8. A gripper for petroleum pipes, the gripper including:

a housing;

two gripper arms, wherein the gripper aims are provided, at first end portions, with gripping surfaces and are pivotable, at opposite end portions, around respective first axes;

first pivotal links connecting each of the gripper arms to the housing, each of the first pivotal links being pivotably connected to the respective gripper arm around a second axis which is between the gripping surface and the first axis, and each of the first pivotal links being pivotably connected to the housing around a third axis; and second pivotal links around the first axis connecting each of the gripper arms to the housing, wherein each of the second pivotal links is pivotably connected to the housing on a respective fourth axis fixed relative to the housing, the two first pivotal links being independently pivotable from the two second pivotal links; and wherein a fourth axle which is concentric with the fourth axis is provided with a toothed wheel which is in mesh with a movable pitch rack, the fourth axle being arranged to transmit torques between the toothed wheel and the second pivotal link.

9. The gripper in accordance with claim 8, wherein the pitch rack is connected to a piston rod belonging to a linear actuator.

10. The gripper in accordance with claim 9, wherein the linear actuator is provided between the third axis and the fourth axis in the housing.

* * * * *